US012773643B2

(12) United States Patent
Bucco et al.

(10) Patent No.: US 12,773,643 B2
(45) Date of Patent: Oct. 27, 2026

(54) BALLOON BANNER

(71) Applicant: American Greetings Corporation, Cleveland, OH (US)

(72) Inventors: Joseph Bucco, Highland Heights, OH (US); Keith Allen, Westlake, OH (US)

(73) Assignee: American Greetings Corporation, Cleveland, OH (US)

( * ) Notice: Subject to any disclaimer, the term of this patent is extended or adjusted under 35 U.S.C. 154(b) by 229 days.

(21) Appl. No.: 18/939,711

(22) Filed: Nov. 7, 2024

(65) Prior Publication Data

US 2026/0124552 A1 May 7, 2026

(51) Int. Cl.
*A63H 27/10* (2006.01)

(52) U.S. Cl.
CPC ..... *A63H 27/10* (2013.01); *A63H 2027/1041* (2013.01); *A63H 2027/1075* (2013.01)

(58) Field of Classification Search
CPC ..... A63H 27/10; A63H 2027/1041
USPC ..... 40/504, 605
See application file for complete search history.

(56) References Cited

U.S. PATENT DOCUMENTS 1,642,022 A * 9/1927 Groh ..... G09F 21/06 40/212
5,514,022 A * 5/1996 Harris ..... A63H 27/10 446/77
5,533,285 A * 7/1996 Skistimas ..... G09F 19/125 434/81
5,769,685 A * 6/1998 Nakamura ..... G09F 7/00 446/221
5,904,258 A * 5/1999 Farmer ..... A47B 81/00 211/124
6,019,660 A * 2/2000 Luciano ..... A63H 27/10 446/223
6,655,057 B2 * 12/2003 Kim ..... G09F 21/06 40/212
9,051,755 B2 * 6/2015 Heining ..... E04H 12/2253
2004/0198146 A1 * 10/2004 Murray ..... A63H 27/10 446/220
2020/0320913 A1 * 10/2020 Dewitt ..... A63H 27/10
2024/0331587 A1 10/2024 Kelly

FOREIGN PATENT DOCUMENTS

DE 202013003955 8/2013

* cited by examiner

*Primary Examiner* — Kurt Fernstrom
(74) *Attorney, Agent, or Firm* — Christine Flanagan

(57) ABSTRACT

The balloon banner of the present disclosure and related inventions provides a convenient and fun decoration for a special event. The banner can be folded into a stacked arrangement for easy storage or for mailing. When needed, the banner can be unfolded, hung and paired with balloons to create a cheerful, celebratory atmosphere. The banner includes backer panels, pop-up elements in the form of alphabet letters, numbers or symbols, several balloon-backing discs, hanger ribbon 16, attachment ribbon and latex balloons.

20 Claims, 9 Drawing Sheets

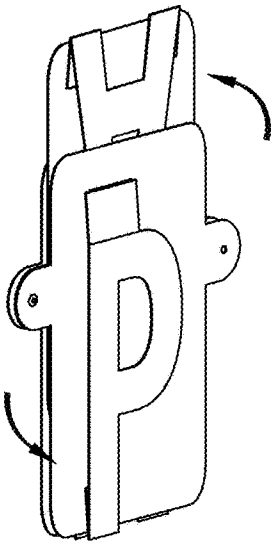
FIG. 11
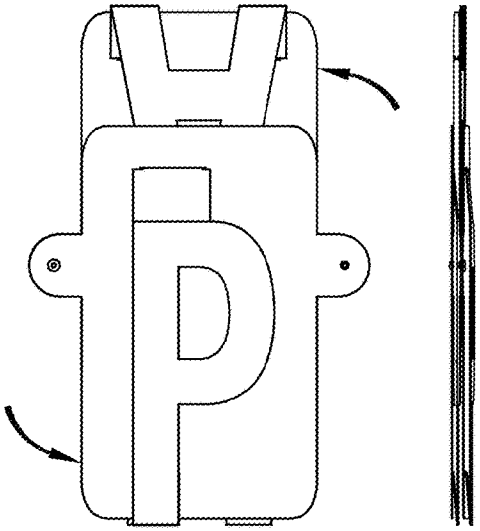
FIG. 12
FIG. 13
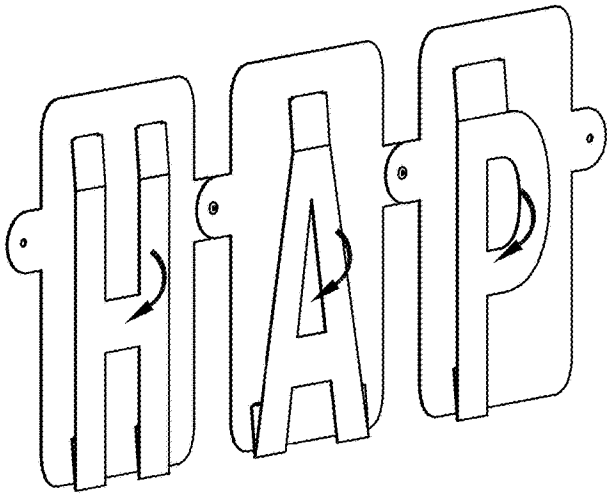
FIG. 8
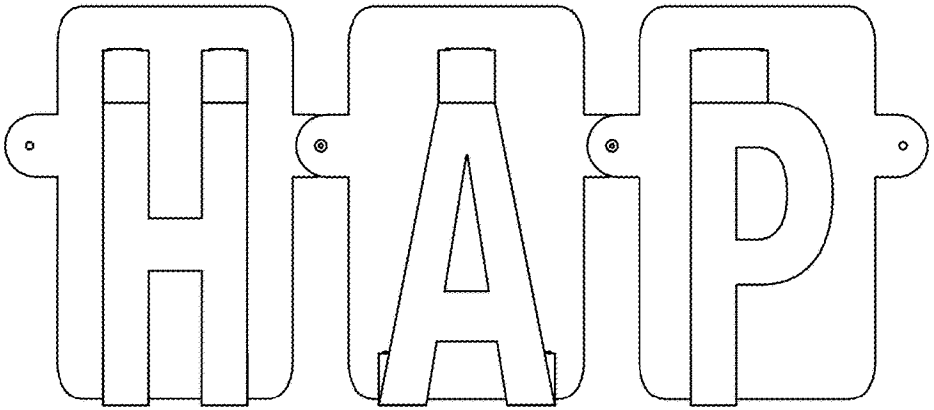
FIG. 10
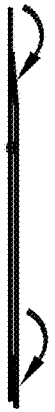
FIG. 9

BALLOON BANNER

CROSS-REFERENCE TO RELATED APPLICATIONS

There are no applications related to this application.

SUMMARY OF THE INVENTION

The present disclosure describes a balloon banner having a plurality of backer panels, one or more backer panels having a ribbon extending from a bottom edge thereof, a plurality of pop-up elements, each one of the plurality of pop-up elements attached to one of the plurality of backer panels, a plurality of balloon backer discs having a plurality of slits thereon forming an aperture in the shape of a star, each one of the plurality of balloon backer discs attached to the ribbon extending from the bottom edge of the one or more backer panels, and a plurality of tied, inflated, latex balloons, a portion of each of the plurality of tied, inflated, latex balloons inserted into one of the apertures located on one of the plurality of balloon backer discs. The plurality of backer panels are connected to at least one other of the plurality of backer panels at a pivot point to create a horizontal chain. The first or leftmost backer panel of the chain and a last or rightmost backer panel of the chain each contain a loop attached thereto, and the balloon banner can move between a first or folded position, wherein it is in a substantially flat and stacked arrangement and a second or unfolded position, wherein it is unfurled into an elongate decoration that can be suspended from a hook or other hanger hardware via the loops on the first and last backer panels.

In another embodiment, the balloon banner contains a plurality of backer panels attached in a horizontal chain, each of the plurality of backer panels having a pop-up element attached thereto, a plurality of balloon backer discs suspended from one or more of the plurality of backer panels, each of the plurality of balloon backer discs having an aperture at a center thereof, and a plurality of inflated balloons, a portion of each of the plurality of balloons inserted into one of the plurality of balloon backer discs. The banner can move from a first position, wherein it is folded into a substantially stacked arrangement, and a second position, wherein it is unfolded into banner that is operative to hang from a hook or hanger hardware via a ribbon attached to each distal end thereof.

In still another embodiment, the balloon banner contains a plurality of backer panels arranged in a horizontal chain, wherein each of the backer panels is attached to and pivotable about at least one other pop-up element, a pop-up letter, number, or symbol attached to each of the plurality of backer panels, a plurality of ribbons, one ribbon attached to the first or leftmost backer panel in the chain, and one ribbon attached to every other odd-numbered backer panel in the chain, a plurality of balloon backer discs attached to each of the plurality of ribbons, and one or more balloons attached to one or more of the plurality of balloon backer discs. The banner can be folded into a flat, stacked configuration.

BRIEF DESCRIPTION OF DRAWINGS

FIG. 8 is a perspective view of FIG. 5, in an unfolded position.

FIG. 9 is a left-side view of FIG. 8.

FIG. 10 is a front view of FIG. 8.

FIG. 11 is a perspective view of FIG. 8, in a folded position.

FIG. 12 is a front view of FIG. 11.

FIG. 13 is a left-side view of FIG. 12.

DETAILED DESCRIPTION OF THE INVENTION

Figure 1:
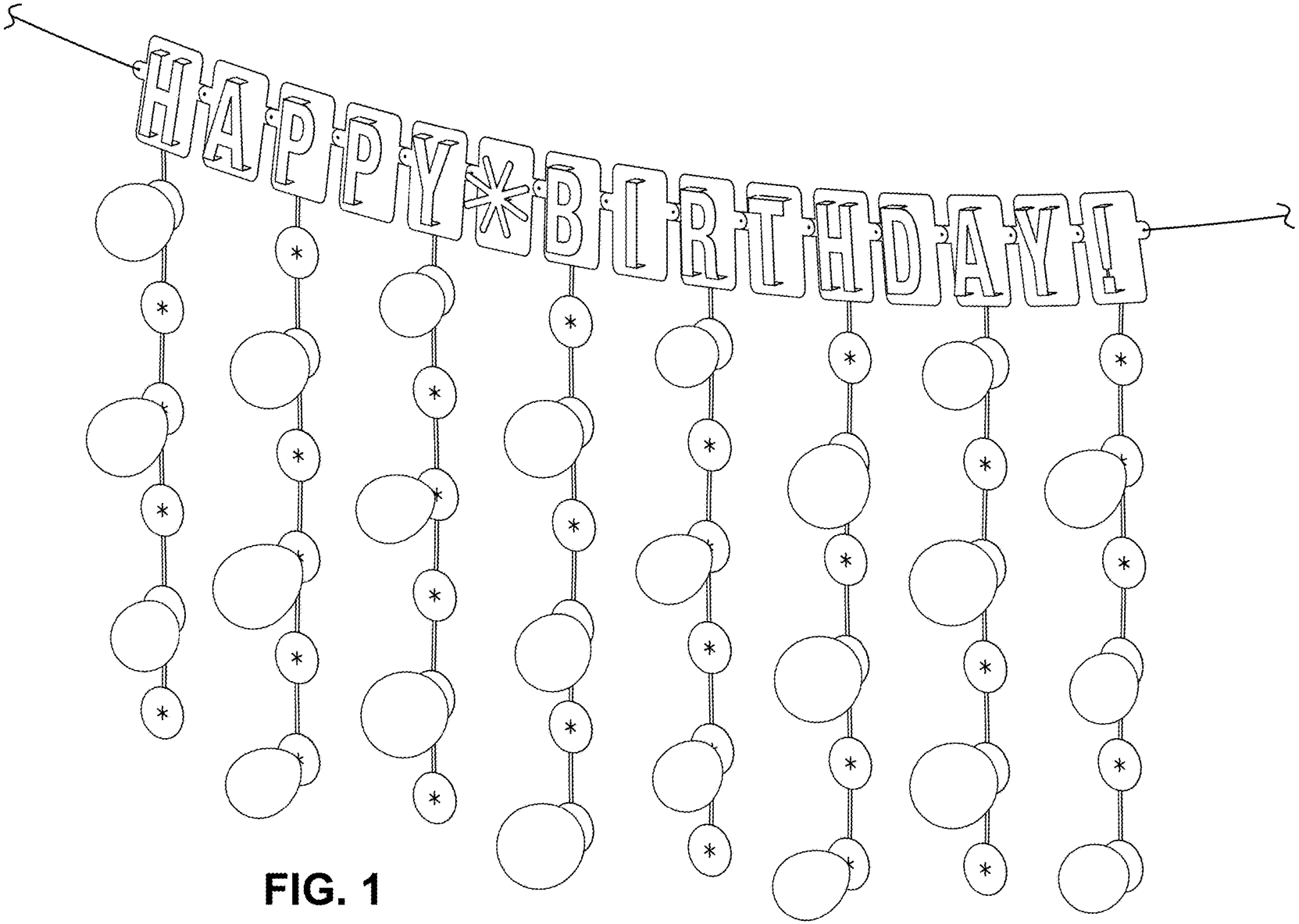
FIG. 1 is a perspective view of the balloon banner of the present invention.

The subject matter of the present disclosure and related inventions is described with specificity herein to meet statutory requirements. However, the description itself is not intended to limit the scope of this patent. Rather, the inventors have contemplated that the claimed subject matter might also be embodied in other ways. Use of articles or terms, such as "a" or "any", that might otherwise seem to refer to items in the singular refer to items in the plural herein, such as "one or more."

The balloon banner (the "banner") 100 of the present disclosure and related inventions provides a convenient and fun decoration for a special event. The banner 100 can be folded into a stacked arrangement for easy storage or for mailing. When needed, the banner 100 can be unfolded, hung and paired with balloons B to create a cheerful, celebratory atmosphere. The banner includes backer panels 10, pop-up elements in the form of alphabet letters, numbers or symbols 12, several balloon-backing discs 14, hanger ribbon 16, attachment ribbon 18 and latex balloons B.

Figure 5:
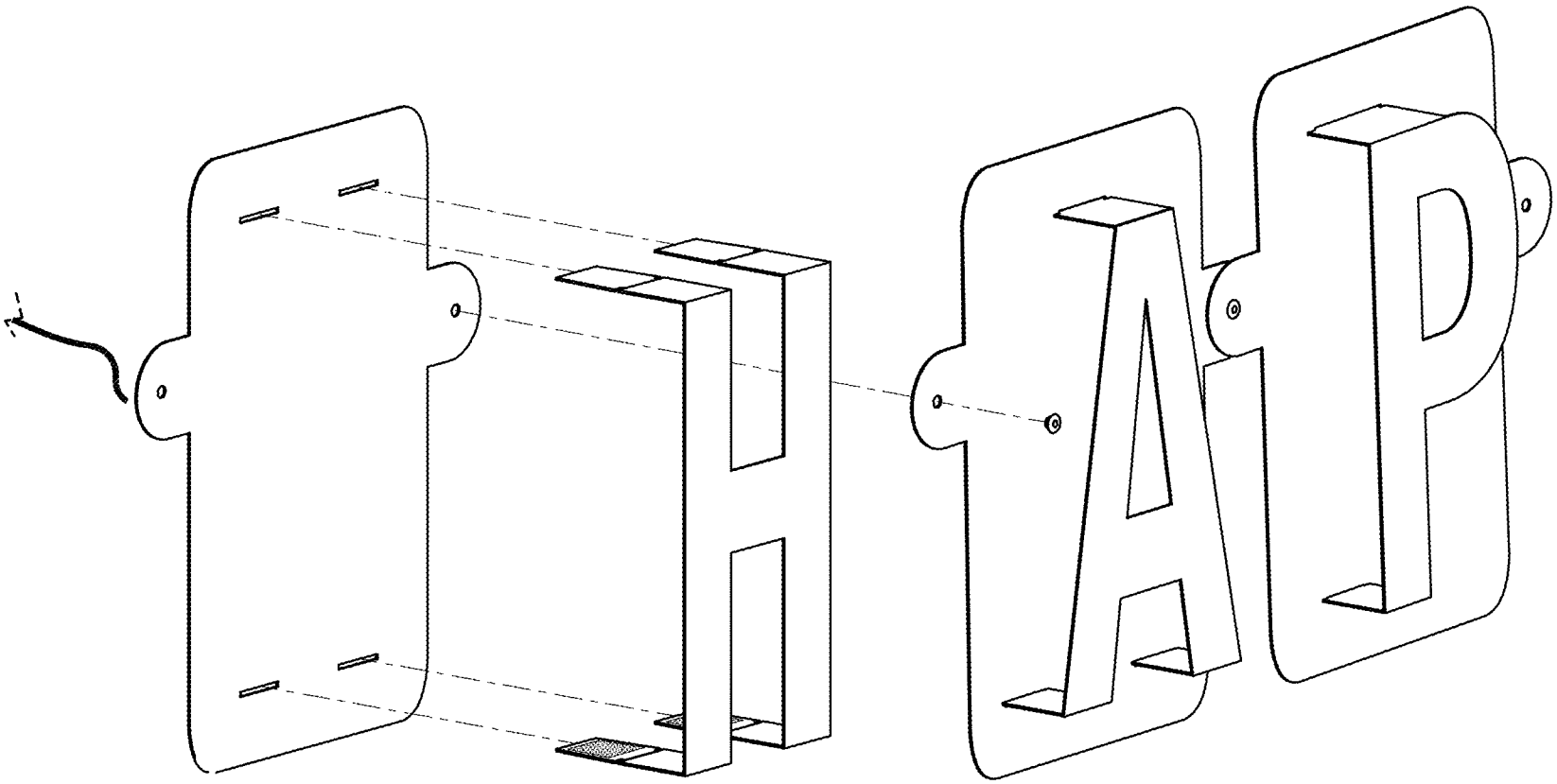
FIG. 5 is an exploded view of a first portion of FIG. 1.
Figure 6:
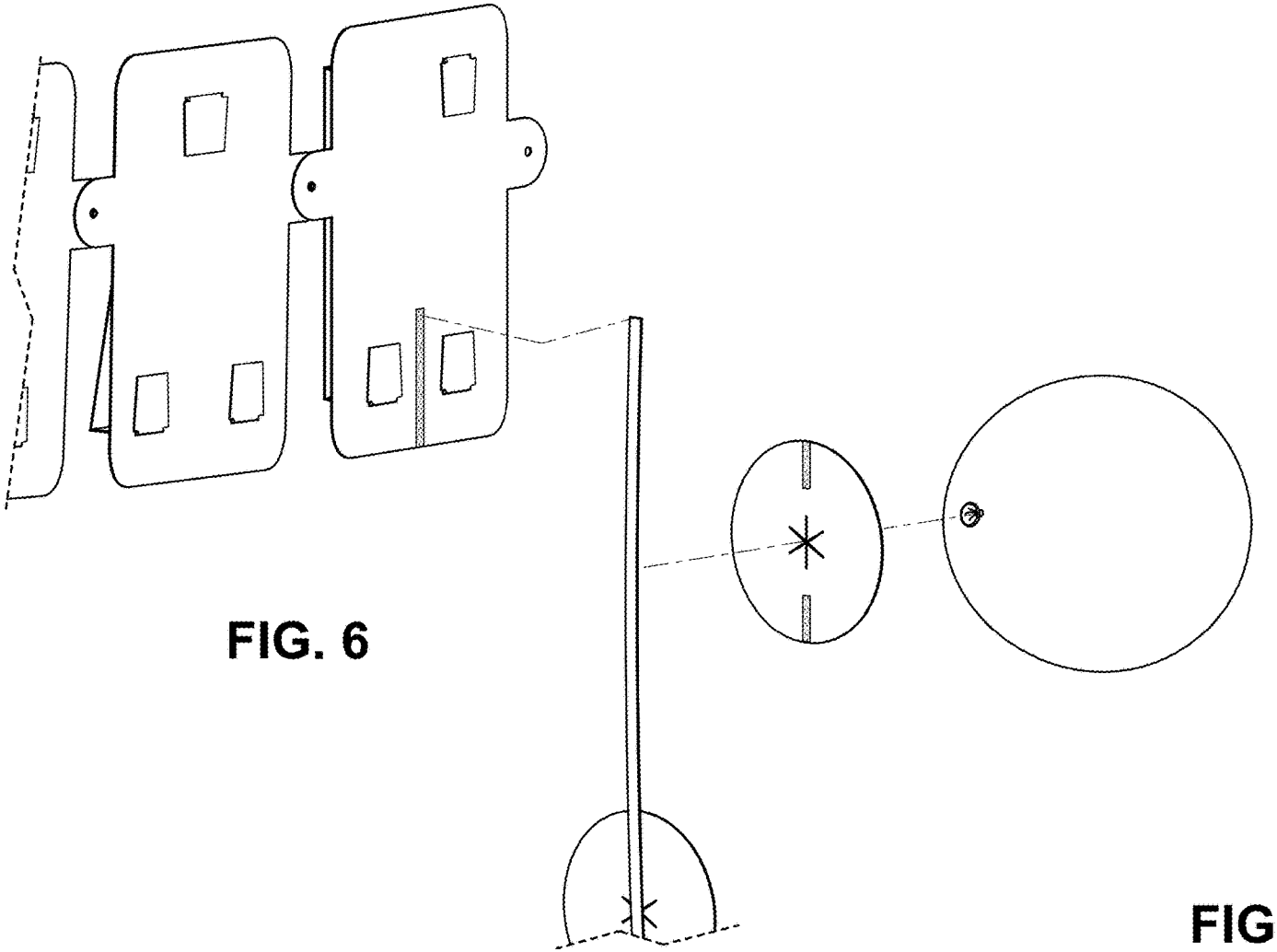
FIG. 6 is an exploded view of a second portion of FIG. 1.
Figure 15:
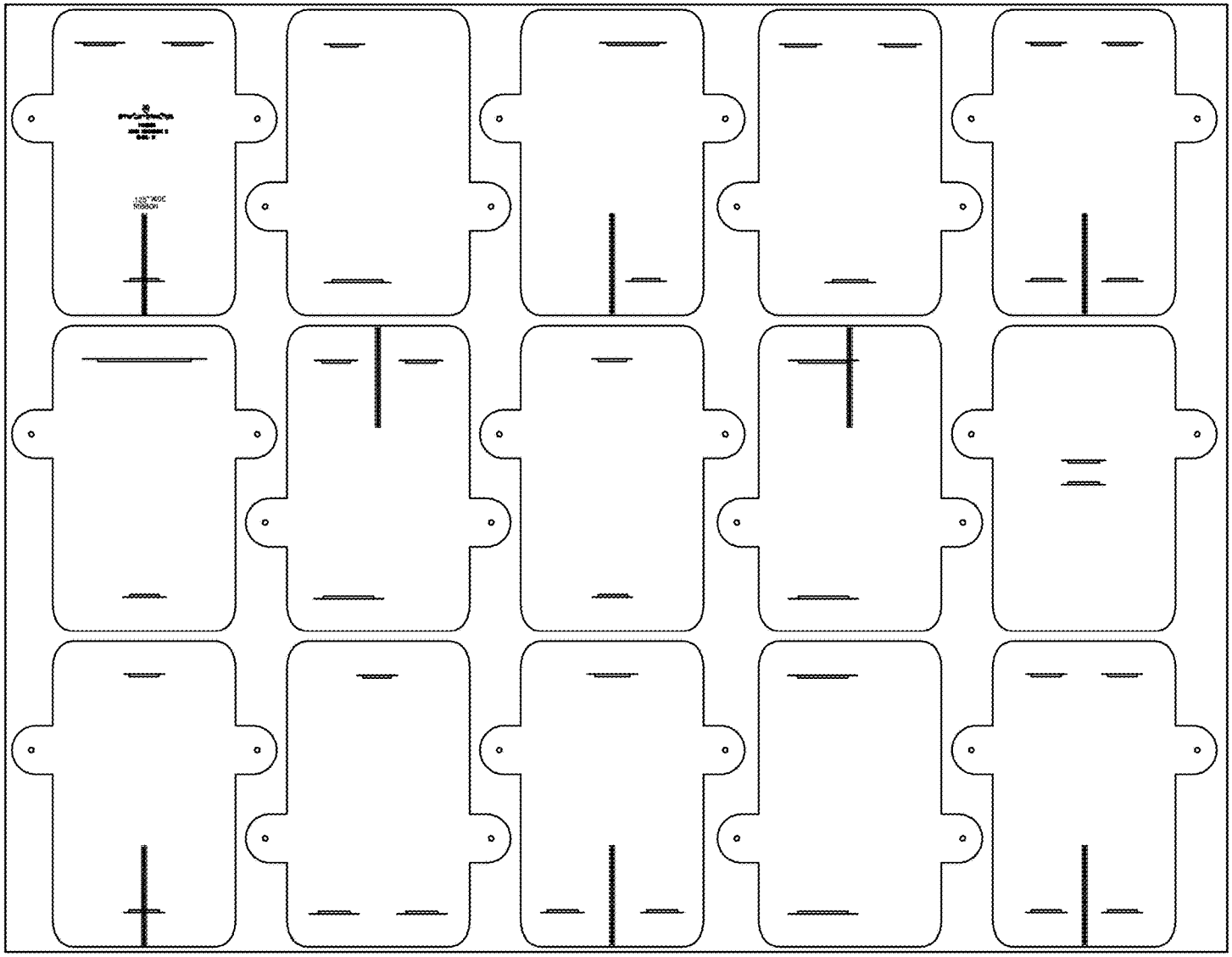
FIG. 15 is a front view of the back side of the backer panels.

The backer panels 10, as shown in FIGS. 5, 6, and 15, are each substantially rectangular-shaped, with two opposing long sides 10L1, 10L2 and two opposing short sides 10S1, 10S2, between and perpendicular to the two opposing long sides 10L1, 10L2. The backer panel 10 has a front surface 10FS and a back surface 10BS opposite the front surface 10FS. The long sides 10L1, 10L2 of each backer panel 10 have a rounded tab 10TR, 10TL protruding therefrom. At the center of each rounded tab 10TR, 10TL is a small circular aperture 10A. Each backer panel 10 also has one or more slits 10S thereon. The number of slits S contained on each backer panel 10 are dependent upon on the pop-up element 12 which will be attached thereto.

Figure 14:
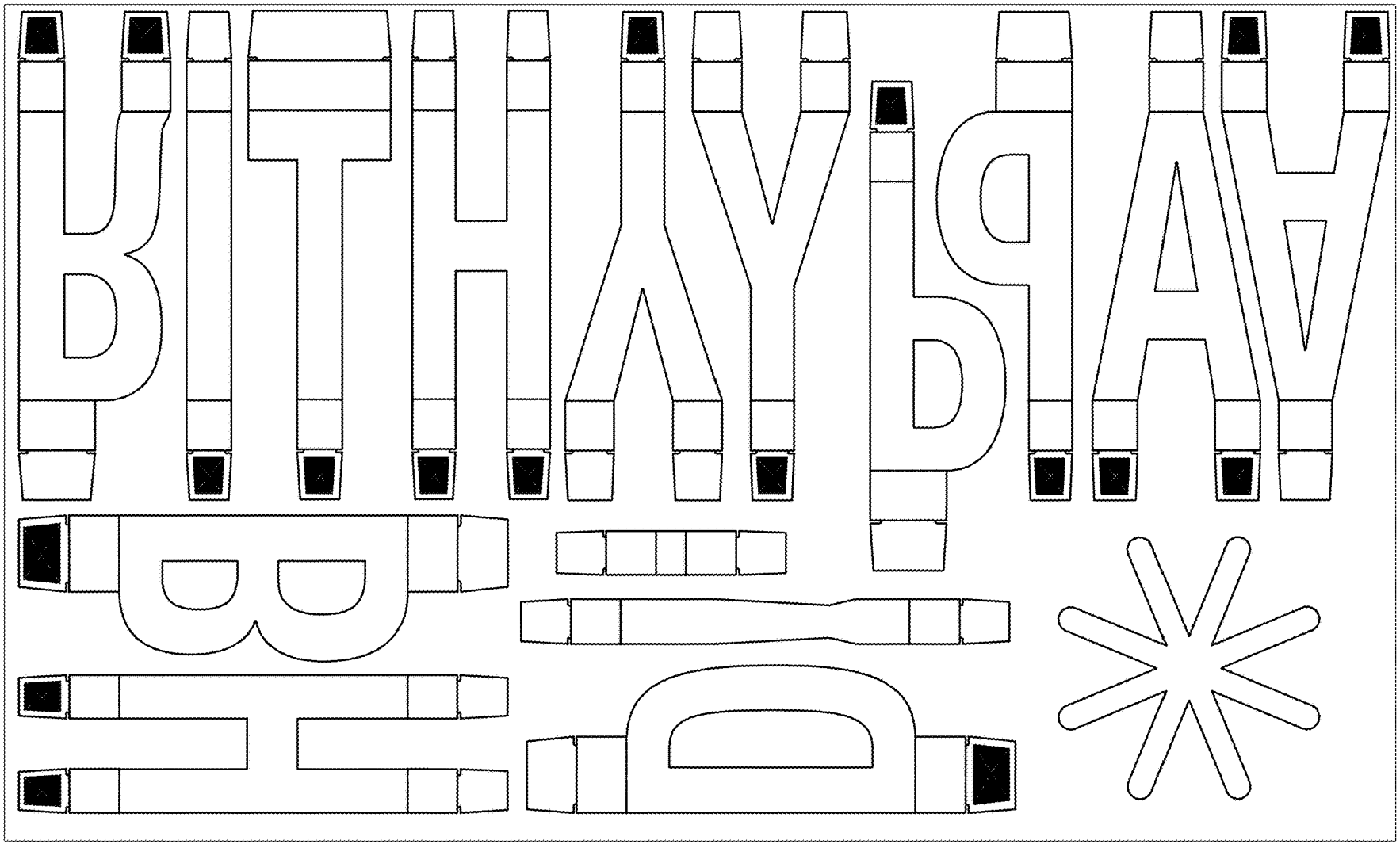
FIG. 14 is a front view of the pop-up elements.

The pop-up elements 12, as shown in FIGS. 5 and 14, take the shape of a letter of the alphabet, a number, or a symbol. Each pop-up element 12 contains one or more tabs 12T connected thereto, along a first fold line F1. Each tab 12T is bisected by a second fold line F2 creating two sub-tabs ST1, ST2. The first sub-tab ST1 is attached directly to (or contiguous with) the pop-up element 12 and a second sub-tab ST2 is attached directly to (or contiguous with) the first sub-tab S2. The number of tabs located on each pop-up element 12 depends on the shape of the pop-up element 12. For example, a pop-up in the shape of the letter "T" would have three tabs thereon—one tab attached to each opposing end of the cross-stroke and one tab attached to the lower edge of the stem, as shown in FIG. 14.

Figure 16:
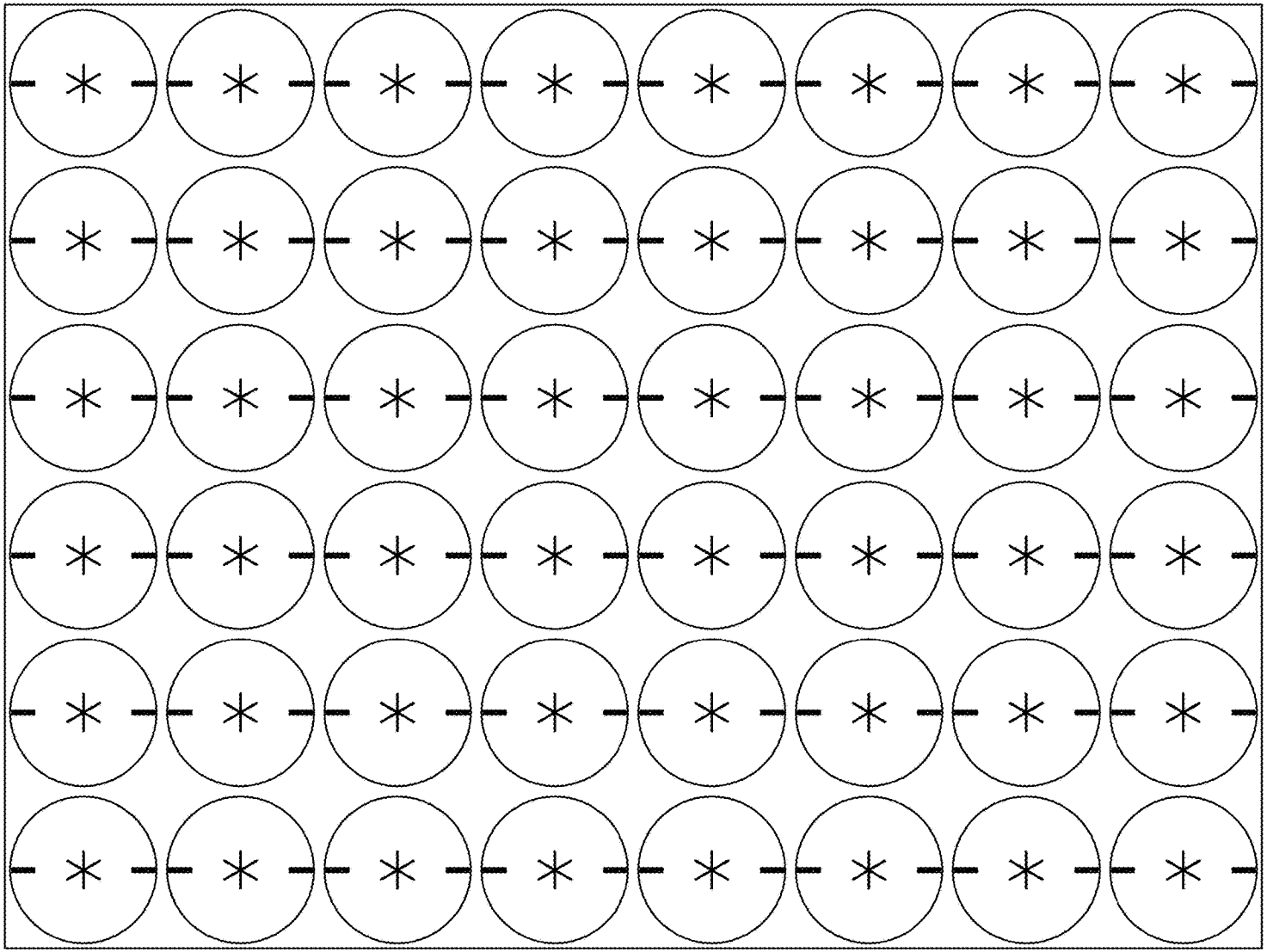
FIG. 16 is a front view of the balloon backing discs.

The balloon backing discs 14, as shown in FIGS. 6 and 16, are individual round-shaped discs, each disc having star-shaped aperture 14A at the center thereof, which is made up of six equal slits 14S in the disc 14 arranged in star configuration. The balloon backing discs 14 additionally contain two adhesive strips AS for attaching the balloon backing discs 14 to the attachment ribbon 18, as shown in FIG. 6.

Each pop-up element 12 is attached to a backer panel 10, as shown in FIGS. 5, 8, 10, 11, and 12. The tabs located on each pop-up element 12 are folded along the first fold line F1 such that the first sub-tab ST1 is perpendicular to the pop-up element 12. The tabs 12T are also folded along the second fold line such that the second sub-tab ST2 is parallel to the pop-up element 12 and perpendicular to the first sub-tab ST1. The second sub-tab ST2 of each pop-up element is inserted into a corresponding slit 10S located on a backer panel 10 and glued or otherwise attached to the rear surface thereof. Each of the first sub-tabs ST1 create space between the pop-up element 12 and the backer panel 10, giving the banner 100 a three-dimensional effect, as shown in FIGS. 1 and 5. When hanging the banner 100, the pop-up elements 12 must be manually moved from a first position, wherein the pop-up elements 12 lie flat against the backer panel 10, with the first sub-tabs ST1 in a parallel position with respect to the backer panel 10, to a second position, wherein pop-up elements 12 are set out from the backer panel 10 by making each of the first sub-tabs ST1 are perpendicular to the backer panel 10.

Figure 3:
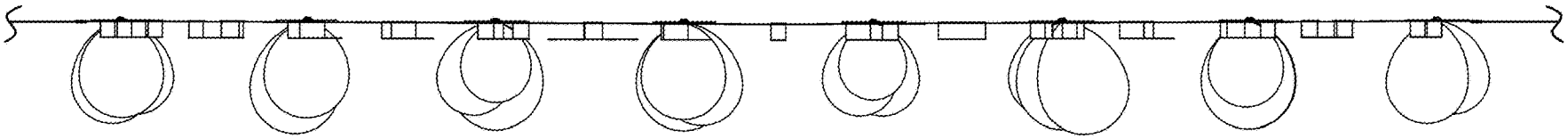
FIG. 3 is a top view of FIG. 2 from the perspective of arrows 3-3.
Figure 7:
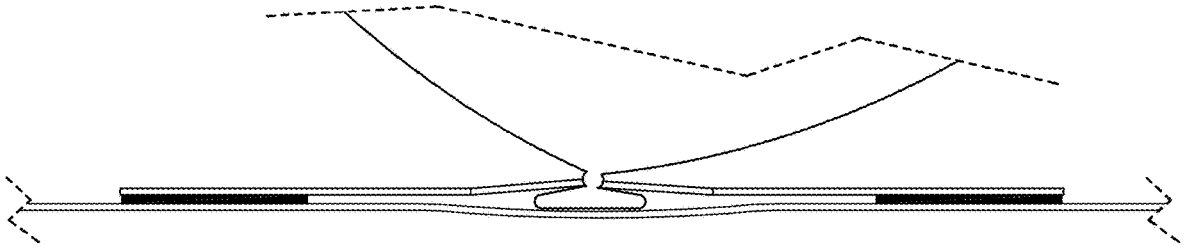
FIG. 7 is a side view of a balloon attached to a balloon backing disc.

The backer panels 10 are attached to one another to form a chain, as shown in FIGS. 8 and 10. From left to right, the tab 10TR on the right side of a first backer panel (leftmost) 10F is attached to the tab 10TL on the left side of a second backer panel 10, and so on, until the last backer panel (rightmost) 10L has been attached to the chain. To connect the backer panels 10 to one another, the rounded tab 10TR on the right side of one backer panel 10 is placed over the rounded tab on the left side 10TL of another backer panel 10, such that the two backer panels 10 are in a stacked arrangement with the circular apertures 10A on each backer 10 aligned. A metal rivet R is used to attached each of the adjacent backer panels 10 together such that they can each pivot about the attachment point, as shown in FIGS. 11 and 12. A hanger ribbon (loop) 16 is inserted into the rounded tab on the left side 10LT of the first (leftmost) backer panel 10F and the rounded tab on the right side 10RT of the last (rightmost) backer panel 10L and tied. These hanger ribbons (loops) 16 are used to hang the banner 100 from a hook or other any other hanger hardware. An attachment ribbon 18 is attached to an adhesive strip AS the rear surface of the first (leftmost) backer panel 10F and every other backer panel (third, fifth, etc.) 10 until the last (rightmost) backer panel 10L is reached, as shown in FIG. 15. Balloon backing discs 14 are attached to each attachment ribbon 18 at spaced apart intervals (see FIG. 3). In one embodiment, for example, there are seven balloon backing discs 14 attached to each attachment ribbon 14. Each balloon backing disc 14 can hold one latex balloon B. The balloons B are removably attached to each balloon backing disc 14 by inserting the tied neck BN of the ballon B into the star-shaped aperture 14A at the center of the balloon backing disc 14, as shown in FIG. 7.

Figure 2:
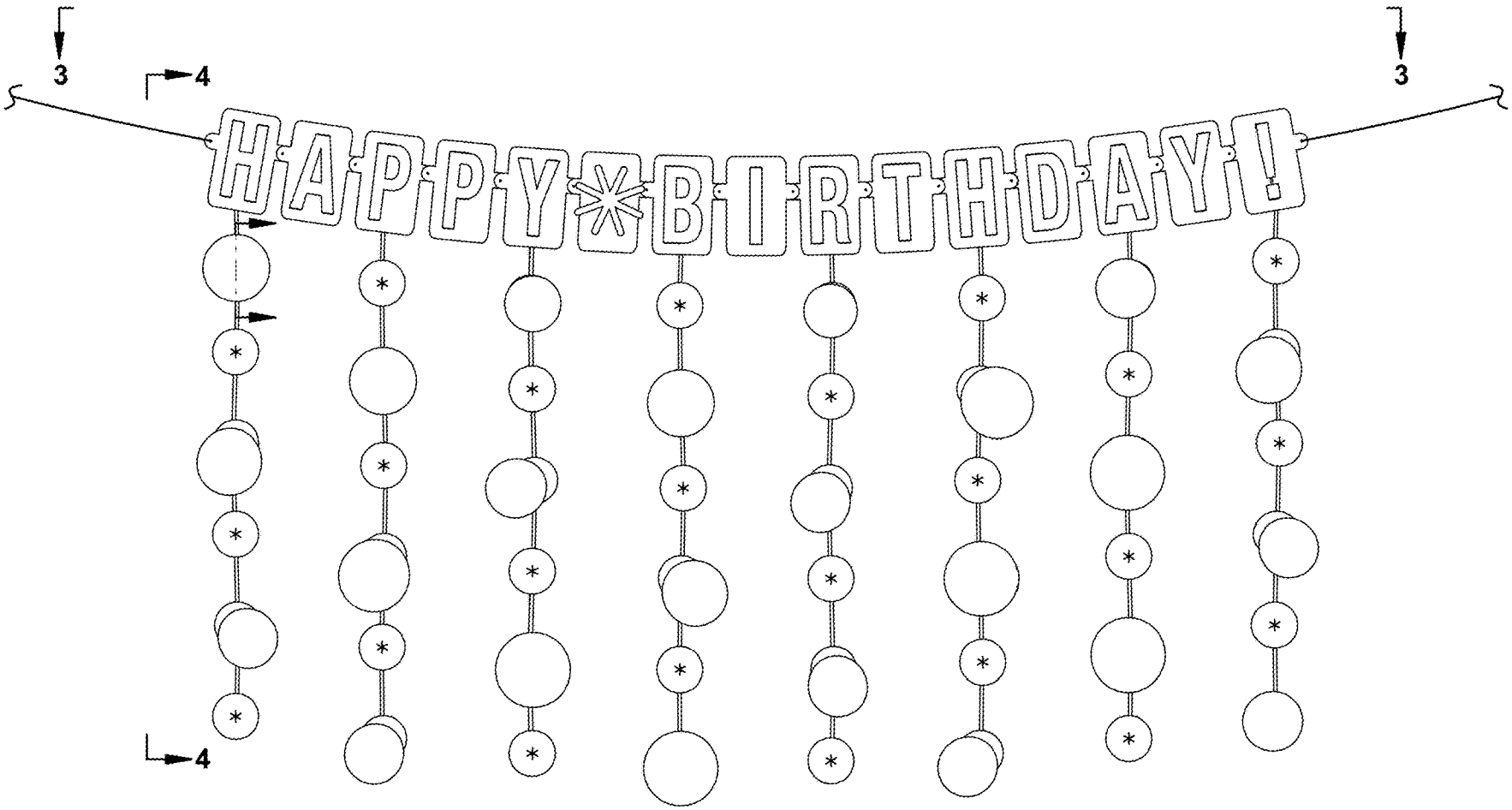
FIG. 2 is a front view of FIG. 1.
Figure 4:
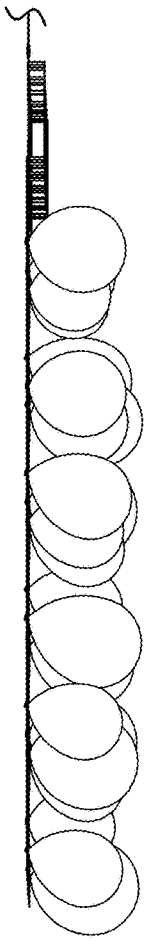
FIG. 4 is a left side view of FIG. 2 from the perspective of arrows 4-4.

The banner 100 can move between a first or folded position and a second or unfolded position. In the first or folded position, the balloon backing discs 14 on each attachment ribbon 18 are folded atop one another and then held together by a belly band or other type of attachment mechanism (this assumes that balloons have been removed). The backer panel 10/pop-up elements 12 can be folded atop one another to form a stacked arrangement, as shown in FIGS. 9, 11, 12, and 13. The backer panel 10/pop-elements 12 can be folded into this configuration by starting at the first backer panel (leftmost) 10F and pivoting the next backer panel (directly adjacent to or to the right side of) in a leftward motion until the backer panel is substantially behind the first backer panel 10F, and so on, until the last backer panel (rightmost) 10L is reached. Alternatively, the backer panel 10/pop-up elements 12 can be folded atop one another by starting with the last backer panel (rightmost) 10L and pivoting the next backer panel (directly adjacent to or to the left side of) in a rightward motion until the backer panel is substantially behind the last backer panel (leftmost) 10F. Once the banner 100 is in the first or folded position, it can be inserted into an envelope for mailing or for storage. In the second or unfolded position, the chain of backer panel 10/pop-up elements 12 are unfolded into a substantially horizontal chain and the balloon backing discs 14 are unattached from one another (by removing the belly band or other attachment mechanism) so that the attachment ribbon 18 can extend downward or swing freely from the backer panels 10. The first backer panel 10F can be suspended from a hook or other hanger hardware using the hanger ribbon 16 which is attached to the circular tab on the left side of the first backer panel 10F. The last backer panel 10L can be suspended from a hook or other hanger hardware using the hanger ribbon 16 which is attached to the circular tab on the right side of the last backer panel 10L. Inflated latex balloons B can be inserted into one or more of the star-shaped apertures on any one of the ballon backing discs 14. Balloons B can be inserted into all the balloon backing discs 14 or in only select balloon backing discs 14 (to form a design or by personal preference), as shown in FIGS. 1, 2 and 4. The banner 100 can easily be moved between the first and second positions, making the banner a versatile party décor element that can be used again and again.

In one embodiment, the backer panels 10, pop-up elements 12 and balloon backing discs 14 are each made of paperboard; however, other lightweight materials have been contemplated and are considered to be within the scope of the present invention. The word "ribbon" has been used to describe the attachment strings which are attached to some of the backer panels 10 and to which the balloon backer discs 14 are attached, but any other attachment mechanism, including but not limited to: string, rubber bands, twine, or rope can also be used in place of a ribbon. The banner 100 can include letters, numbers and shapes that may spell out any particular word or phrase. The number of slits S in the backer panels 10 depend on the number of tabs which are located on the pop-up elements 12, so therefore, the number of slits on the backer panel 10 will at least be the same as the number of tabs on the attached pop-up element 12 and have slits on the backer panels 10 will be aligned with the location of the tabs on the attached pop-up element. The banner 100 can include any number of balloon backer discs 14 and balloons B.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A balloon banner comprising:

a plurality of backer panels, one or more backer panels having a ribbon extending from a bottom edge therefrom;

a plurality of pop-up elements, each one of the plurality of pop-up elements attached to one of the plurality of backer panels;

a plurality of balloon backer discs having a plurality of slits thereon forming an aperture in the shape of a star, each one of the plurality of balloon backer discs attached to the ribbon extending from the bottom edge of the one or more backer panels; and a plurality of tied, inflated, latex balloons, a portion of each of the plurality of tied, inflated, latex balloons inserted into one of the apertures located on one of the plurality of balloon backer discs;

wherein the plurality of backer panels are connected to at least one other of the plurality of backer panels at a pivot point to create a horizontal chain;

wherein a first or leftmost backer panel of the chain and a last or rightmost backer panel of the chain each contain a loop attached thereto;

wherein the balloon banner can move between a first or folded position, wherein it is in a substantially flat and stacked arrangement and a second or unfolded position, wherein it is unfurled into an elongate decoration that can be suspended from a hook or other hanger hardware via the loops on the first and last backer panels.

2. The balloon banner of claim 1, wherein the pop-up elements are in the shape of a letter of the alphabet, a number, or a symbol.

3. The balloon banner of claim 1, wherein the plurality of pop-up elements can move between a first position wherein they are flat against one of the plurality of backer panels and a second position, wherein they are pushed forward away from one of the plurality of backer panels.

4. The balloon banner of claim 1, wherein every other backer panel in the chain has a ribbon suspended from a bottom edge thereof.

5. The balloon banner of claim 1, wherein a tied neck portion of the plurality of latex balloons is inserted into the aperture on the plurality of balloon backer panels.

6. The balloon banner of claim 1, wherein each balloon backing disc is circular shaped.

7. The balloon banner of claim 1, wherein each backer panel is substantially rectangular shaped.

8. A balloon banner comprising;

a plurality of backer panels attached in a horizontal chain, each of the plurality of backer panels having a pop-up element attached thereto;

a plurality of balloon backer discs suspended from one or more of the plurality of backer panels, each of the plurality of balloon backer discs having an aperture at a center thereof; and a plurality of inflated balloons, a portion of each of the plurality of balloons inserted into one of the plurality of balloon backer discs;

wherein the banner can move from a first position, wherein it is folded into a substantially stacked arrangement, and a second position, wherein it is unfolded into banner that is operative to hang from a hook or hanger hardware via a ribbon attached to each distal end thereof.

9. The balloon banner of claim 8, wherein the pop-up elements are in the shape of a letter of the alphabet, a number, or a symbol.

10. The balloon banner of claim 8, wherein the plurality of pop-up elements can move between a first position wherein they are flat against a front surface of one of the plurality of backer panels and a second position, wherein they are set forward from the front surface of one of the plurality of backer panels.

11. The balloon banner of claim 8, wherein each of the plurality of backer panels is pivotable about at least one other of the plurality of backer panels.

12. The balloon banner of claim 8, wherein the balloon backer discs are attached to a ribbon which is attached to one of the plurality of backer panels.

13. The balloon banner of claim 8, wherein every other backer disc in the chain has one or more balloon backer discs suspended therefrom.

14. The balloon banner of claim 9, wherein the pop-up elements spell out a word.

15. The balloon banner of claim 9, wherein the pop-up elements spell out a phrase.

16. A balloon banner comprising:

a plurality of backer panels arranged in a horizontal chain, wherein each of the backer panels is attached to and pivotable about at least one other pop-up element;

a pop-up letter, number, or symbol attached to each of the plurality of backer panels;

a plurality of ribbons, one ribbon attached to the first or leftmost backer panel in the chain, and one ribbon attached to every other odd-numbered backer panel in the chain;

a plurality of balloon backer discs attached to each of the plurality of ribbons; and one or more balloons attached to one or more of the plurality of balloon backer discs;

wherein the banner can be folded into a flat, stacked configuration.

17. The balloon banner of claim 16, wherein each of the plurality of pop-up letters, numbers, or symbols can be manually moved from a first position, wherein it is flat against one of the plurality of backer panels, and a second position, wherein it is popped forward away from the backer panel.

18. The balloon banner of claim 16, wherein the first or leftmost backer panel in the chain and the last or rightmost backer panel in the chain has a loop attached thereto.

19. The balloon banner of claim 16, wherein the one or more balloons are attached to one or more of the plurality of balloon backing discs by inserting the tied neck of the balloon into a star-shaped aperture at the center thereof.

20. The balloon banner of claim 16, wherein the pop-up elements spell out a word or a phrase.

* * * * *